US006736066B2

(12) United States Patent
Liebig et al.

(10) Patent No.: US 6,736,066 B2
(45) Date of Patent: May 18, 2004

(54) COMBUSTION PICK-UP ROLLER IN A PRINTING-PLATE EXPOSER

(75) Inventors: Norbert Liebig, Felm (DE); Wilhelm Paulsen, Kiel (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/086,297

(22) Filed: Mar. 1, 2002

(65) Prior Publication Data

US 2002/0088359 A1 Jul. 11, 2002

Related U.S. Application Data

(63) Continuation of application No. PCT/DE00/02958, filed on Aug. 31, 2000.

(30) Foreign Application Priority Data

Sep. 6, 1999 (DE) ..... 199 42 409

(51) Int. Cl.[7] ..... B41F 35/00
(52) U.S. Cl. ..... 101/425; 101/423; 101/415.1
(58) Field of Search ..... 101/425, 423, 101/415.1

(56) References Cited

U.S. PATENT DOCUMENTS 3,807,853 A * 4/1974 Hudson ..... 399/357
5,566,617 A * 10/1996 Durrnagel ..... 101/483
5,784,963 A * 7/1998 Schmid ..... 101/425
5,870,954 A 2/1999 Lovenstein et al.
5,927,205 A 7/1999 Jentzsch et al.
6,196,128 B1 * 3/2001 Corrado et al. ..... 101/425
6,244,179 B1 * 6/2001 Sasaki ..... 101/401.1
6,513,432 B1 * 2/2003 Richter ..... 101/425

FOREIGN PATENT DOCUMENTS

| | | |
|---|---|---|
| DE | 196 00 846 C1 | 4/1997 |
| DE | 196 02 328 A1 | 7/1997 |
| EP | 0 882 582 A1 | 12/1998 |
| JP | 58 202 232 | 11/1983 |

* cited by examiner

*Primary Examiner*—Charles H. Nolan, Jr.
*Assistant Examiner*—Andrea H Evans
(74) *Attorney, Agent, or Firm*—Laurence A. Greenberg; Werner H. Stemer; Ralph E. Locher

(57) ABSTRACT

In an exposure device for exposing thermal printing plates having a plate drum holding the printing plates and a pressure roller pressing the pressure plates onto the plate drum during the clamping and unclamping of the printing plates, a device for eliminating combustion residues in an exposer for printing plates includes a pick-up roller in contact with the pressure roller and picking up the combustion residues adhering to the pressure roller. The pick-up roller preferably has an adhesive surface and the pressure roller has a non-adhesive surface.

2 Claims, 1 Drawing Sheet

COMBUSTION PICK-UP ROLLER IN A PRINTING-PLATE EXPOSER

CROSS-REFERENCE TO RELATED APPLICATION

This application is a continuation of copending International Application No. PCT/DE00/02958, filed Aug. 31, 2000, which designated the U.S.

BACKGROUND OF THE INVENTION

Field of the Invention

The invention relates to the fields of electronic reproduction technology and printing technology and pertains to a device for eliminating combustion residues in an exposer for printing plates.

In an exposer for printing plates, an exposure unit is moved in the axial direction along a rotating drum, on which a printing plate to be exposed is clamped. The exposure unit produces one or more laser beams, which are modulated with image signal values and which expose one or more circumferential lines on the printing plate, pixel by pixel. As a result, the printing plate surface is given the property of subsequently accepting or repelling printing ink at the exposed points in the printing machine, depending on the type of printing plate used. During the exposure of thermal printing plates, a surface layer present on the printing plate is burned away selectively by the high energy of the laser beams. Thermal printing plates are advantageous because they need no chemical development following exposure, are environmentally friendly and, immediately after the exposure, can be used for printing.

During the exposure of thermal printing plates, dust-like combustion residues are produced, which can cause various problems. Combustion residues that get into the exposure path of a laser beam cause energy losses and, as a result, produce exposure faults. After a relatively long operating time, combustion residues can cause all possible unforeseeable functional disruptions as a result of being deposited on various functional units in the exposure appliance. Combustion residues that adhere to the exposed printing plate are transferred to a pressure roller used for the unclamping operation during the unclamping of the printing plate from the exposer and, when a new printing plate is being clamped by the same pressure roller, can be transferred to the new printing plate.

According to the prior art, combustion residues are extracted by a suction device, whose suction nozzle is fitted as close as possible to the rotating drum. However, with such a technique it is not possible to remove the combustion residues completely, so that faults of the type described can continue to occur.

SUMMARY OF THE INVENTION

It is accordingly an object of the invention to provide a combustion pick-up roller in a printing-plate exposer that overcomes the hereinafore-mentioned disadvantages of the heretofore-known devices of this general type and that eliminates combustion residues in an exposer for thermal printing plates with which the removal of the combustion residues is improved considerably so that faults caused by combustion residues can no longer occur.

With the foregoing and other objects in view, there is provided, in accordance with the invention, an exposure device for exposing thermal printing plates by selectively burning away a surface of a printing plate, including a plate drum for holding the printing plate, a pressure roller pressing the printing plate onto the plate drum during clamping and unclamping operations of the printing plate, and a pick-up roller in contact with the pressure roller, the pick-up roller picking up combustion residue adhering to the pressure roller.

With the objects of the invention in view, in an exposure device for exposing thermal printing plates by selectively burning away a surface of a printing plate, the exposure device having a plate drum for holding the printing plates and a pressure roller pressing the printing plate onto the plate drum during clamping and unclamping operations of the printing plate, there is also provided a cleaning device including a pick-up roller in contact with the pressure roller, the pickup roller picking up combustion residue adhering to the pressure roller.

In accordance with another feature of the invention, the pick-up roller is in direct contact with the pressure roller.

In accordance with a further feature of the invention, the pick-up roller has an adhesive surface picking up combustion residue adhering to the pressure roller.

In accordance with a concomitant feature of the invention, the pressure roller has a non-adhesive surface.

Other features that are considered as characteristic for the invention are set forth in the appended claims.

Although the invention is illustrated and described herein as embodied in a combustion pick-up roller in a printing-plate exposer, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
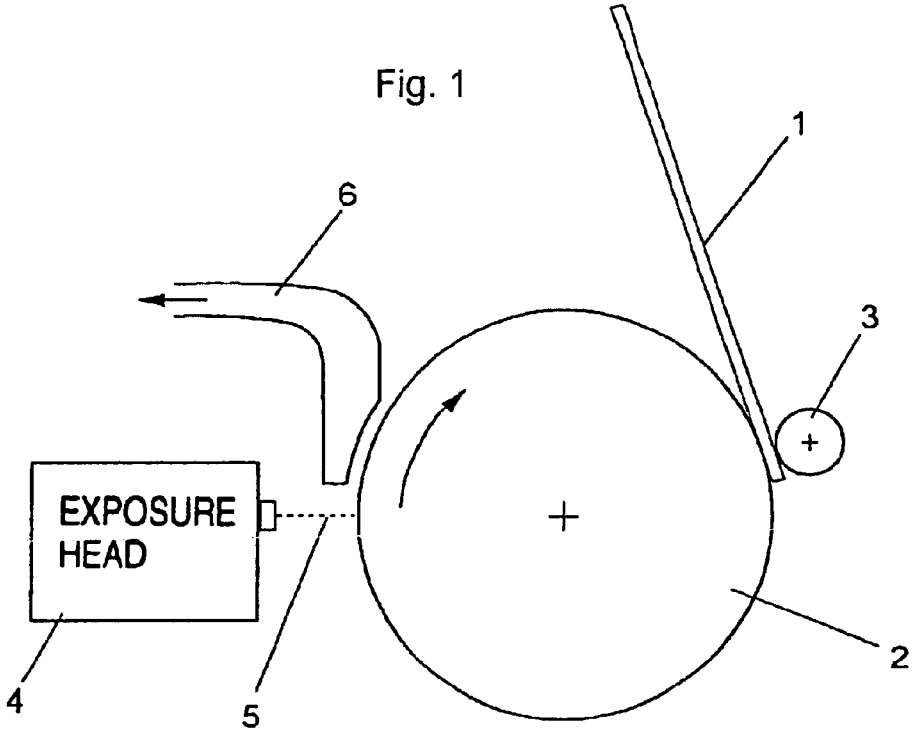
FIG. 1 is a cross-sectional view of a prior art exposer for thermal printing plates.

Referring now to the figures of the drawings in detail and first, particularly to FIG. 1 thereof, there is shown the basic functioning of an exposer for thermal printing plates according to the prior art. Before the exposure, a printing plate (1) to be exposed is clamped onto a plate drum (2). For such a purpose, the leading edge of the printing plate (1) is fixed on the plate drum (2) by non-illustrated clamps. The printing plate (1) is then wound onto the plate drum (2) as the plate drum (2) rotates slowly, a pressure roller (3) pressing the printing plate (1) onto the plate drum (2). At the end of the clamping operation, the trailing edge of the printing plate (1) is fixed onto the plate drum (2) by non-illustrated clamps.

During the exposure, an exposure head (4) produces one or more laser beams (5) that are modulated with image signal values. The plate drum (2) with the printing plate (1) clamped thereon rotates, and the exposure head (4) moves along in the axial direction on the plate drum (2) so that the printing plate (1) is exposed line by line. The laser beams (5) burn away parts of a surface layer of the printing plate (1)

selectively. As a result, the printing plate (1) is given the property of subsequently accepting printing ink at specific points in the printing machine and of picking up no printing ink at the other points. Combustion residues produced during the exposure are extracted and carried away by a suction device (6).

Following the exposure, the plate drum (2) is rotated slowly in the opposite direction to unclamp the exposed printing plate (1) again. In the process, the printing plate is guided away from the pressure roller (3) again. The prior art device described has a disadvantage that combustion residues not extracted and that adhere to the exposed printing plate (1) are transferred to the pressure roller (3) during the unclamping of the printing plate (1). Then, when a new printing plate is being clamped on, such residues are transferred from the pressure roller (3) onto the new printing plate.

Figure 2:
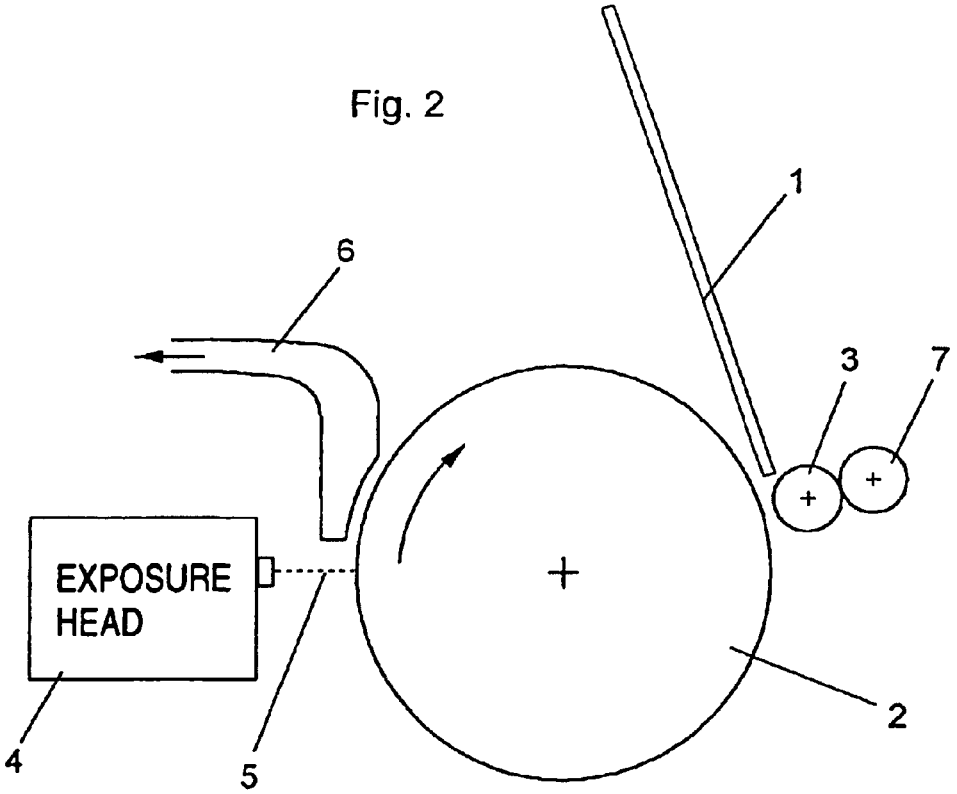
FIG. 2 is a cross-sectional view of an exposer for thermal printing plates according to the invention.

FIG. 2 shows the functioning of an exposer for thermal printing plates with the device according to the invention. In addition to the pressure roller (3), there is a pick-up roller (7) in contact with the pressure roller (3) and preferably having an adhesive surface. The adhesive surface of the pick-up roller (7) is achieved, for example, by coating with rubber or with silicone material. A further preferred embodiment of the invention is for the pressure roller (3) to be provided with a non-adhesive surface that, for example, is achieved by coating with a smooth plastic film. As a result of the non-adhesive surface of the pressure roller (3), the pressure roller (3) picks up considerably fewer combustion residues adhering to the printing plate (1). The combustion residues that remain adhering to the exposed printing plate (1) do not interfere during printing because they are washed away by the moistening of the printing plate with water and printing ink performed in the printing machine.

Remaining combustion residues, which nevertheless pass onto the pressure roller (3), are transferred to the pick-up roller (7) by the adhesive surface thereon. Thus, the adhesive surface continually cleans the pressure roller (3). Such a configuration substantially decreases, or entirely prevents combustion residues from being transferred to a new printing plate when that new printing plate is being clamped on.

We claim:

1. An exposure device for exposing thermal printing plates by selectively burning away a surface of a printing plate, comprising:

a plate drum for holding the printing plate;

a pressure roller pressing the printing plate onto said plate drum during clamping and unclamping operations of the printing plate, said pressure roller having a non-adhesive surface; and a pick-up roller in contact with said pressure roller, said pick-up roller having an adhesive surface and picking up combustion residue adhering to said pressure roller.

2. In an exposure device for exposing thermal printing plates by selectively burning away a surface of a printing plate, the exposure device having a plate drum for holding the printing plates and a pressure roller with a non-adhesive surface pressing the printing plate onto the plate drum during clamping and unclamping operations of the printing plate, a cleaning device comprising:

a pick-up roller in contact with the pressure roller, said pick-up roller having an adhesive surface and picking up combustion residue adhering to the pressure roller.

* * * * *